United States Patent [19]

Takamiya et al.

[11] Patent Number: 5,003,354

[45] Date of Patent: Mar. 26, 1991

[54] METHOD OF REMOVING A FILM FROM AN IMAGE CARRIER OF AN IMAGE FORMING APPARATUS

[75] Inventors: Yoshio Takamiya, Tokyo; Kazuyuki Sugihara, Kawasaki; Chikara Imai, Tokyo; Nobuyuki Koinuma; Yuji Sawai, both of Yokohama, all of Japan

[73] Assignee: Ricoh Company, Ltd., Tokyo, Japan

[21] Appl. No.: 442,584

[22] Filed: Nov. 29, 1989

[30] Foreign Application Priority Data

| | | | |
|---|---|---|---|
| Dec. 3, 1988 | [JP] | Japan | 63-305144 |
| Mar. 30, 1989 | [JP] | Japan | 1-36998[U] |
| Mar. 30, 1989 | [JP] | Japan | 1-37000[U] |
| Jul. 8, 1989 | [JP] | Japan | 1-80443[U] |
| Oct. 31, 1989 | [JP] | Japan | 1-284058 |

[51] Int. Cl.[5] ..... G03G 21/00

[52] U.S. Cl. ..... 355/305; 118/652; 355/301; 430/125

[58] Field of Search ..... 355/305, 301, 306, 296; 430/125; 118/652

[56] References Cited

U.S. PATENT DOCUMENTS

| | | | |
|---|---|---|---|
| 3,849,171 | 11/1974 | Takahashi et al. | 430/125 X |
| 4,024,838 | 5/1977 | Horie | 118/661 |
| 4,258,115 | 3/1981 | Magome et al. | 118/652 X |
| 4,350,750 | 4/1982 | Suzuki et al. | 430/125 |
| 4,380,388 | 4/1983 | Moran et al. | 118/652 X |
| 4,420,242 | 12/1983 | Yamashita | 355/301 X |
| 4,754,304 | 6/1988 | Ohashi et al. | 430/125 X |

FOREIGN PATENT DOCUMENTS

| | | | |
|---|---|---|---|
| 0171346 | 10/1982 | Japan | 118/652 |
| 0125079 | 7/1983 | Japan | 355/305 |
| 0172289 | 7/1988 | Japan | 355/259 |

*Primary Examiner*—A. T. Grimley
*Assistant Examiner*—Thu Anh Dang
*Attorney, Agent, or Firm*—Oblon, Spivak, McClelland, Maier & Neustadt

[57] ABSTRACT

A method of removing a film from a photoconductive element of a color copier or similar image forming apparatus. At a suitable time when an image forming mode operation for forming a toner image on the photoconductive element is not under way, an amount of cleaning agent great enough to scrape a film off the photoconductive element is transported to a region between the photoconductive element and a cleaning sleeve. Subsequently, the amount of cleaning agent to be transported to such a region is reduced. This sequence of steps is repeated a plurality of times.

17 Claims, 8 Drawing Sheets

METHOD OF REMOVING A FILM FROM AN IMAGE CARRIER OF AN IMAGE FORMING APPARATUS

BACKGROUND OF THE INVENTION

The present invention relates to a method of removing a film from an image carrier of an image forming apparatus.

An image forming apparatus of the type electrostatically forming a latent image on an image carrier, developing the latent image by a toner, and transferring the resulting toner image to a paper sheet is extensively used. This kind of apparatus is implemented as a printer or a facsimile machine, for example. A problem with such an apparatus is that while the image carrier is repetitively used, various particles such as toner, paper dust and additives contained in paper are apt to form a thin film on the image carrier. Filming on the image carrier locally increases the density of a toner image and contaminates the background, thereby degrading the quality of the toner image to a critical extent. Various approaches have heretofore been proposed to remove such a film from the image carrier. Typical of prior art approaches are an abrasive or an abrasive brush for polishing the surface of the image carrier, and a blade for scraping the film off the surface of the image carrier in pressing contact with the latter, as disclosed in Japanese Patent Laid-Open Publication (Kokai) Nos. 62-119567, 60-107076, and 60-119589 by way of example.

However, the prior art approaches stated above have some problems left unsolved. Specifically, the abrasive brush or similar extra member for removing the film adds to the cost of the image forming apparatus. Moreover, the brush or the blade which contacts the image carrier is apt to cause the image carrier to wear to thereby produce unusual stripe-like images while reducing the service life of the image carrier.

SUMMARY OF THE INVENTION

It is an object of the present invention to provide a method capable of effectively removing a film from an image carrier of an image forming apparatus.

It is another object of the present invention to provide a method which effectively removes a film from an image carrier without reducing the life of the image carrier and without increasing the cost.

It is another object of the present invention to provide a method which enhances efficient removal of a film by increasing the retaining force of an agent carrier acting on a cleaning agent and the amount of transport of the agent and thereby increasing the stiffness of a magnet brush which is formed by the agent.

It is another object of the present invention to provide a method which removes a film from an image carrier effectively and uniformly over the entire image carrier by agitating a cleaning agent in the axial direction of an agent carrier.

It is another object of the present invention to provide a film removing method for an image forming apparatus which efficiently agitates a cleaning agent by drawing a great amount of cleaning agent toward agent agitating means.

A method of removing a film from an image carrier of an image forming apparatus comprising the image carrier for forming a toner image thereon during an image forming mode operation, an agent carrier located to face the image carrier for transporting an agent which is a mixture of carrier and toner and at least partly constituted by a magnetic substance while retaining the agent on the agent carrier, and a regulating member for regulating an amount of the agent to be transported to a region between the image carrier and the agent carrier of the present invention comprises (a) transporting, at a time other than a time when the image forming mode opearation is under way, an amount of the agent great enough to scrape the film off the image carrier to the region between the image carrier and the agent carrier, (b) reducing the amount of the agent to be fed to the region, and performing steps (a) and (b) a plurality of times.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
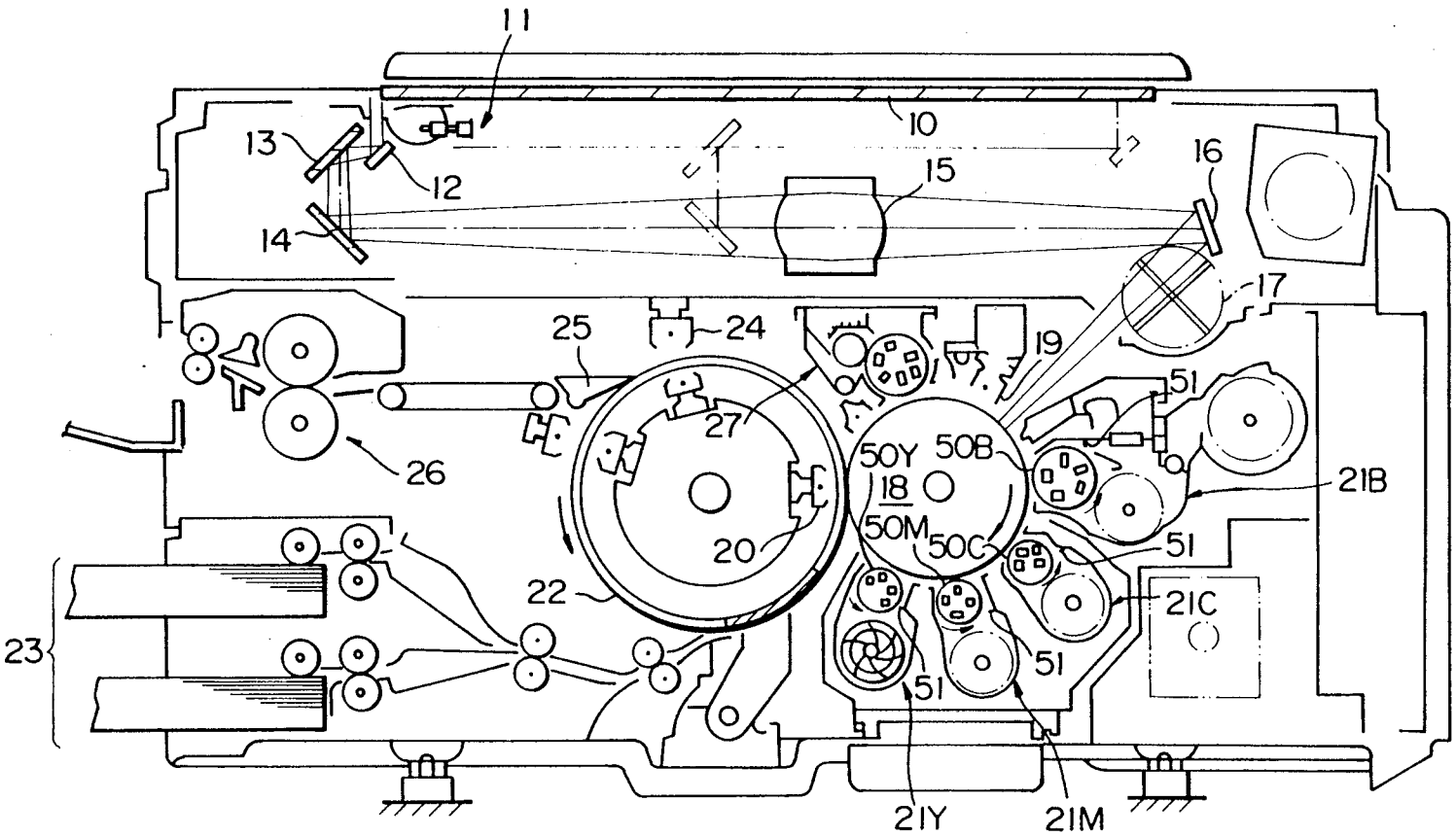
FIG. 1 is a copier belonging to a family of image forming apparatuses to which the present invention is applicable.

To better understand the present invention, a brief reference will be made to the general construction of a color copier having a magnet brush type cleaning device to which the present invention is applied by way of example, shown in FIG. 1. As shown, the copier has a glass platen 10 on which an original document (not shown) is laid. An illuminating device 11 is moved together with a first mirror 12 to the right as viewed in the figure, while illuminating the document on the glass platen 10. A reflection from the document is incident to a lens 15 via a second 13 and a third mirror 14 which are moved in the same direction as the first mirror 12. The lens 15 focuses the imagewise reflection onto a photoconductive element 18 by way of a fourth mirror 16 and a filter assembly 17. The photoconductive element is a specific form of an image carrier and, in this embodiment, implemented as a drum. The drum 18 is rotated clockwise as viewed in FIG. 1. The filter assembly 17 has a plurality of color separating filters and separates a blue component, for example, by one of the filters. The blue component is focused onto the drum 18 which has been uniformly charged by a charger 19, whereby a latent image is electrostatically formed on the drum 18.

A yellow, a magenta and a cyan developing unit 21Y, 21M and 21C, respectively, are located below the drum 18. A latent image formed on the drum 18 by the above procedure is developed by a yellow toner which is stored in the yellow developing unit 21Y. The resulting toner image is transferred by a transfer charger 20 to a paper sheet which has been fed from a sheet feed section 23 and wound around a transfer drum 22. The paper sheet is representative of an image recording medium applicable to the copier. In the same manner, a magenta toner image and a cyan toner image are individually transferred from the drum 18 to the paper sheet one upon the other. A black developing unit 21B is also installed in the copier for developing a latent image by a black toner. A black toner image is formed by using or not by using an ND filter. After the image transfer, the paper sheet is separated from the drum 22 by an exclusive charger 24 and a pawl 25 and then driven out of the copier via a fixing device 26. Every time a toner image is transferred from the drum 18 to the paper sheet, the drum 18 is cleaned by a magnet brush type cleaning device 27 so as to remove residual toner particles and is thereby prepared for the next image forming cycle.

In the illustrative copier, an editor may be mounted on the glass platen 10 to produce a partial copy or a combined copy, as desired.

The magnetic brush type cleaning device 27 to which the present invention is applied is usually constructed and operated as follows.

Figure 2:
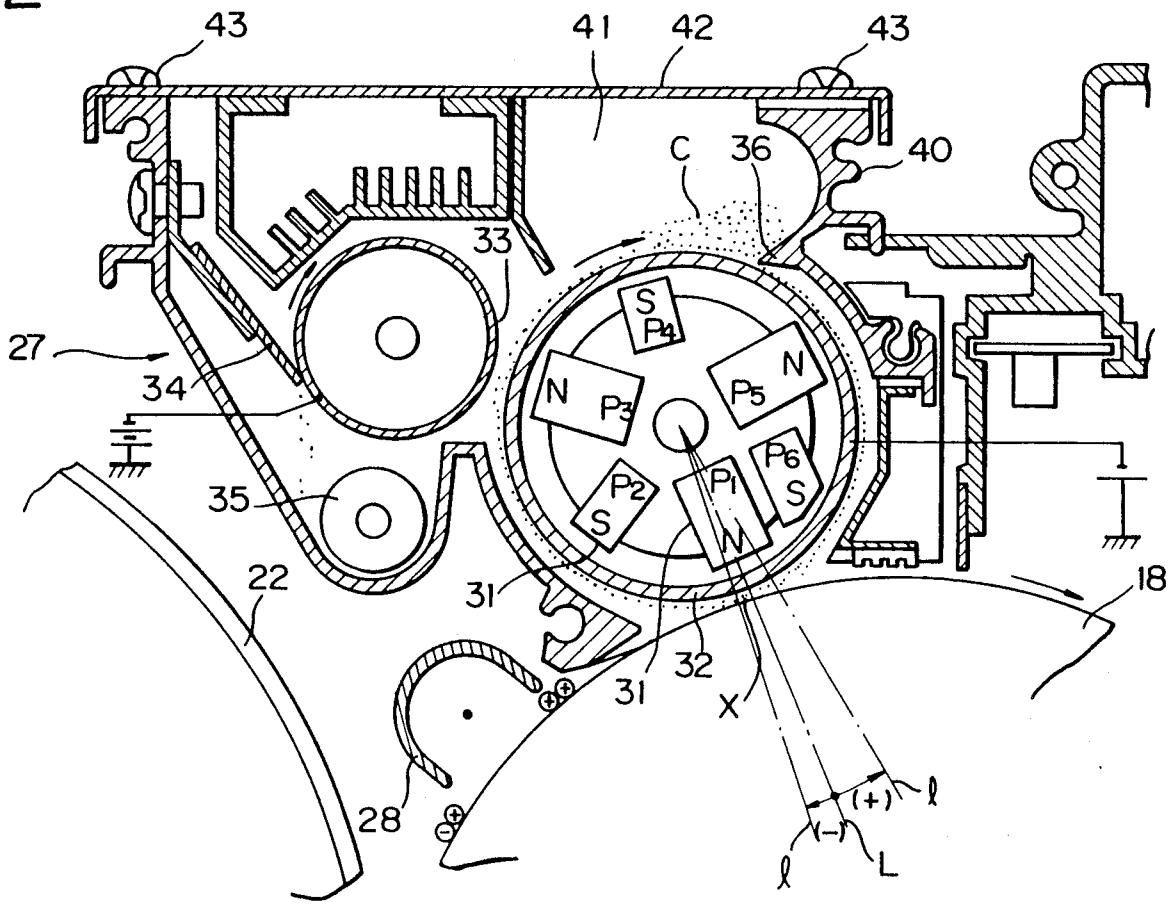
FIG. 2 is an enlarged section of a magnet brush type cleaning device.

As shown in FIG. 2, a precleaning charger 28 is located in a position downstream of an image transfer position where the drum 18 and transfer drum 22 contact each other, with respect to the direction of rotation of the drum 18. The precleaning charger 28 is oriented to face the drum 18. The cleaning device 27 has a cleaning sleeve 32 which is positioned downstream of the precleaning charger 28 and made of a non-magnetic material such as aluminum. A plurality of magnets 31 are accommodated in the cleaning sleeve 32 (the individual magnets 31 are labeled P1 to P6). The cleaning sleeve 32 is a specific form of a carrier for carrying a cleaning agent. In the cleaning device 27, the cleaning sleeve 32 is rotated by a motor (not shown) clockwise as indicated by an arrow in FIG. 2 relative to the stationary magnets 31. The magnets 31 have magnetic poles which are arranged along the circumference of the cleaning sleeve 32 as indicated by S and N. As the toner particles remaining on the drum 18 after image transfer arrives as the precleaning charger 28, the charger 28 deposits a charge of predetermined polarity (positive in this example) on the residual particles by corona discharge so as to facilitate the removal of the particles.

On the other hand, the magnets 31 accommodated in the cleaning sleeve 32 magnetically retain on the periphery of the cleaning sleeve 32 a cleaning agent C which is the mixture of magnetic carrier and magnetic or non-magnetic toner, the carrier forming a magnetic brush. More specifically, the magnets 31 magnetically attract the carrier particles onto the cleaning sleeve 32 so as to retain the cleaning agent C on the sleeve 32. A toner is sometimes implemented by a toner only and sometimes by a mixture of toner and additive. In any case, the toner particles and the carrier particles are charged by friction to different polarities resulting in the toner particles being electrostatically deposited on the carrier particles. As the cleaning sleeve 32 is rotated clockwise, the cleaning agent C at least a part of which is constituted by a magnetic substance is transported by the sleeve 32 and caused into contact with the surface of the drum 18 at a cleaning region X. When the residual toner having been charged by the precleaning charger 28 arrives at the cleaning region X where it faces the cleaning sleeve 32, it is deposited by electrostatic attraction and mechanical scavenging force on the cleaning carrier which is retained on the cleaning sleeve 32. In this instance, a bias voltage opposite in polarity to the toner (negative in this example) is applied to the cleaning sleeve 32 so that the cleaning carrier is negatively charged. In this manner, the residual toner on the drum 18 is removed by the cleaning agent C.

The carrier on which the residual toner has been deposited is transported by the cleaning sleeve 32 while forming a magnet brush on the sleeve 32. A toner collecting roller 33 is made of metal, for example, and applied with a bias voltage of predetermined polarity (negative in this example). When the carrier on the sleeve 32 arrives at a position where it faces the toner collecting roller 33, it is brought into contact with the roller 33 and electrostatically deposited on the latter. Serving as toner collecting means, the toner collecting roller 33 is applied with a bias voltage which is more intense than the negative bias which is applied to the cleaning sleeve 32. In this condition, only the positively charged toner is transferred from the cleaning sleeve 32 to the toner collecting roller 33, while the negatively charged carrier is left on the cleaning sleeve 32. At this instant, a certain amount of toner is left on the cleaning sleeve 32 and turns out to be the toner contained in the cleaning agent C. A blade 34 is made of elastic rubber or resilient metal and held in contact with the roller 33 which is rotating clockwise. The blade 34, therefore, scrapes the toner off the collecting roller 33. The toner so scraped off the collecting roller 33 is discharged to the outside of the cleaning unit 27 by a screw 35.

The cleaning agent C on the cleaning sleeve 32 is further transported to a doctor blade 36. The doctor blade 36 regulates the thickness of the cleaning agent C to about 0.5 millimeter to about 2.0 millimeters, the regulated agent C being again fed into the cleaning region X. The cleaning sleeve 32 and toner collecting roller 33 are journalled to opposite side walls of a cleaning case 40. A cover 42 is removably fastened to the top of the case 40 by screws 43 so as to cover an opening 41 which is formed through the top of the case 40.

As stated above, the toner remaining on the drum 18 is collected by the cleaning agent C which is retained on the cleaning sleeve 32. The drum 18 cleaned by the agent C is repetitively used thereafter.

The doctor blade 36 is a specific form of regulating means for regulating the amount of cleaning agent to be transported to the cleaning region X between the drum 18 and the cleaning sleeve 32 and thereby promoting adequate cleaning.

As described above, the copier shown in FIGS. 1 and 2 has the drum 18 for carrying a toner thereon during an image forming mode, cleaning sleeve 32 located to face the drum 18 for transporting the cleaning agent C while magnetically retaining it thereon, and the doctor blade 36 for regulating the amount of cleaning agent C to be transported to the region X between the drum 18 and the sleeve 32.

Among the toner particles transferred from the drum 18 to the cleaning sleeve 32, those insufficiently charged and those left non-charged despite the operation of the precleaning charger 28 are caused to float off the cleaning sleeve 32 and often deposit on the drum 18 again. Besides, toner particles scattered around from the developing units 21Y, 21M, 21C and 21B, paper dust and additives contained in paper are apt to deposit on the surface of the drum 18. Such toner particles and paper dust are sequentially adhered to the drum surface with the lapse of time, filming the drum surface. The filming renders the sensitivity distribution of the drum 18 irregular to thereby produce an irregular density distribution of a toner image on the drum 18 or to contaminate the background. It is necessary, therefore, to remove the film from the drum 18 as soon as possible or to prevent such particles from filming the drum 18.

The copier described above removes the film by using the magnet brush type cleaning device 27. Specifically, at a time other than the time when an image forming mode for forming a toner image on the drum 18 is under way as stated earlier, i.e., in a film removing mode, a greater amount of cleaning agent than during an ordinary cleaning operation is fed to the region X between the drum 18 and the cleaning sleeve 32 in the filming removing mode. More specifically, the drum 18 is operated with a greater amount of cleaning agent C being filled in the region X than during ordinary copying operation. In this condition, a mass of cleaning agent stays in the cleaning region X so that the carrier particles of the cleaning agent C is strongly rubbed against the surface of the drum 18 to scrape the filming off the drum 18. Such a manner of removal is implemented by the increase in the contact pressure acting between the cleaning agent C, i.e., magnet brush and the surface of the drum 18 as well as the increase in their coefficient of friction. This is successful in removing the film or preventing such a film from forming on the drum 18. Even if the drum 18 has some eccentricity, the mass of cleaning agent C staying in the region X will remove the film over the entire surface of the drum 18.

In the cleaning device 27 of the type rotating the cleaning sleeve 32 relative to the stationary magnets 31 to transport the cleaning agent C, the amount of cleaning agent C to be fed to the cleaning region X can be increased for the purpose of removing a film only if the sleeve 32 is rotated at a lower speed than during an ordinary cleaning operation. Specifically, when the linear velocity of the cleaning sleeve 32 is lowered, the centrifugal force acting on the cleaning agent C which is retained thereon is weakened so that the agent C is strongly attracted onto the surface of the sleeve 32. Consequently, a greater amount of cleaning agent C is transported away from the doctor blade 36 toward the cleaning region X. This kind of implementation does not need any extra member for removing a film and, therefore, cuts down the cost of the apparatus. Moreover, no excessive external forces act on the drum 18 in contrast to the prior art implementation which relies on an abrasive brush or a blade. An abrasive brush or a blade held in pressing contact with the drum 18 would cause the latter to wear soon or scratch the latter to reduce the service life.

While the cleaning agent C staying in the cleaning region X and sequentially increasing in amount as stated above is successful in promoting effective removal of a film from the drum 18, it may occur that the agent filling the region X constitutes a substantial load on the drum 18 due to friction and, in the worst case, this load is sequentially increased to such an extent that the drum 18 and cleaning sleeve 32 are disenabled to rotate. Should the cleaning sleeve 32 and drum 18 be fully stopped, the film would not be removed at all and the supply of such a large amount of cleaning agent C to the cleaning region X would become meaningless. Of course, while such a problem will be eliminated if the amount of cleaning agent C fed to the cleaning region X is suppressed or if a greater gap is defined between the drum 18 and the cleaning sleeve 32, then the film removing effect will degraded.

In accordance with the present invention, after a great amount of cleaning agent C has been fed to the cleaning region X to remove a film as stated above, the amount of transport of the agent C to the region X is reduced. Specifically, after a greater amount of cleaning agent C has been transported to the cleaning region X by lowering the rotation speed of the cleaning sleeve 32, the rotation speed of the sleeve 32 is increased again. Then, the centrifugal force acting on the cleaning agent C which is retained on the cleaning sleeve 32 will be increased to render the agent C ready to slip on the surface of the sleeve 32. This allows the amount of cleaning agent C moving away from the blade 36 to be reduced to substantially the same amount as during ordinary cleaning operation. Hence, before the load acting on the drum 18 and cleaning sleeve 32 due to the cleaning agent C increases to such an extent that the drum 18 and sleeve 32 become jammed and unable to rotate, it is reduced to insure the rotation of the drum 18 and sleeve 32. Subsequently, the rotation speed of the cleaning sleeve 32 is lowered to increase the amount of cleaning agent C to fed to the cleaning region X, whereby the agent is filled in the region X to remove a film. Such a sequence is repeated a suitable number of times to effectively remove a film without causing the drum 18 and sleeve 32 into a halt.

Assume that the linear velocities of the cleaning sleeve 32 and drum 18 are VS and VP, respectively. Experiments showed that a film can be efficiently removed without the drum 18 and sleeve 32 being stopped if the linear velocities VS and VP are so selected as to satisfy a relation $0<|VS/VP|<0.5$ when a greater amount of cleaning agent C is fed to the cleaning region for removing a film and a relation $|VS/VP|>0.5$ when the amount of cleaning agent C is to be reduced.

For the experiments mentioned above, the various components included in the copier of FIGS. 1 and 2, especially in the cleaning unit 27, were conditioned as follows.

(1) Flux density as measured at the pole of magnet P1 shown in FIG. 1: 1000 gauss to 1100 gauss (2) Flux density as measured as the pole of magnet P2: 1200 gauss to 1300 gauss (3) Position of magnet P1 constituting the main pole: Assuming that a line L connecting the centers of the cleaning sleeve 32 and drum 18 is the reference, and that a line l passing through the center of the sleeve 32 defines a positive (+) and a negative (−) angle relative to the line L as shown in FIG. 2, the magnet P1 is located in an angular range of −2 degrees to +8 degrees.

(4) Bias voltage applied to cleaning sleeve 32: DC−150 volts (5) Bias voltage applied to toner collecting roller 33: DC−500 volts (6) Linear velocity (peripheral speed) (VS) of cleaning sleeve during ordinary cleaning: 300 millimeters per second (7) Linear velocity (peripheral speed) (VP) of drum 18: 200 millimeters per second (8) Gap between cleaning sleeve 32 and doctor blade 36: 0.8 millimeter (9) Gap between cleaning sleeve 32 and drum 18: 1.0 millimeter

(10) Toner concentration in the cleaning agent C relative to carrier: 0.5 to 2 weight percent

(11) Charge deposited on toner in cleaning agent C: 10 to 80 microcoulombs per gram

(12) Carrier configuration in cleaning agent C: irregular

The procedure outlined previously will be described specifically with reference to FIG. 3. As shown, when the main switch of the copier is turned on, the copier starts on a drum cleaning mode. Specifically, a drum drive motor is energized to rotate the drum 18 while a cleaning sleeve drive motor is energized to rotate the cleaning sleeve 32 clockwise as viewed in FIG. 2. In this condition, toner particles remaining on the drum 18 are deposited on the cleaning agent C, more precisely on the carrier, which is retained on the cleaning sleeve 32, whereby the drum 18 is cleaned. On the lapse of a predetermined period of time, the cleaning mode is replaced with a film removing mode. In the film removing mode, the cleaning sleeve 32 is repetitively rotated at a low speed ($0<|VS/VP|<0.5$) and a high speed ($|VS/VP|>0.5$) alternately so as to scrape a film off the drum 18. At the same time, the alternation of the low and high speeds frees the sleeve 32 and drum 18 from a load which would otherwise be constituted by the cleaning agent and would stop the rotation of the latter. In the specific procedure shown in FIG. 3, the speed of the cleaning sleeve 32 during the high speed rotation is selected to be the same as the speed in the drum cleaning mode.

Figure 3:
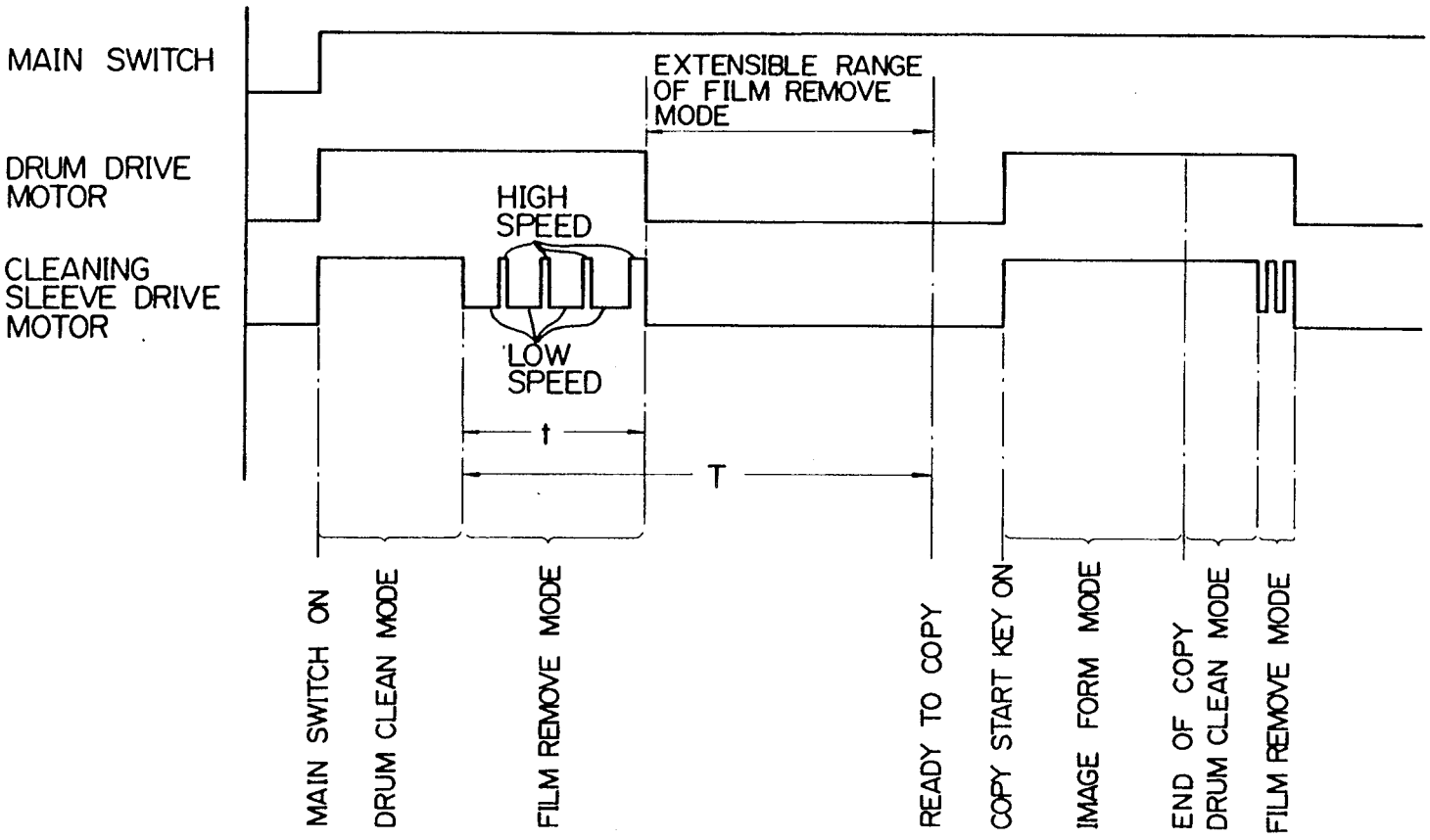
FIG. 3 is a timing chart representative of a sequence of operations including a film removing operation.

In FIG. 3, labeled T is the interval between the end of the drum cleaning mode and the end of warm-up of the fixing unit or similar component of the copier to a predetermined temperature. While the film removing operation is shown as continuing only during a part t of the period of time T, it may be effected over any suitable range within the period of time T or even throughout the period of time T. This is what is meant by the words "extensible range of film remove mode" shown in FIG. 3. On the lapse of the period of time T, the copier is ready to operate and will start operating when a copy start key thereof is pressed. The drum 18 is cleaned during and after a sequence of copying operations. This is followed by the film removing mode in which the cleaning sleeve 32 repetitively rotates at the high and low speeds alternately for removing a film from the drum 18.

It will be seen from the above that the film removing operation in accordance with the present invention can be executed at any suitable time other than the time at which the image forming mode is under way.

The motor for driving the cleaning sleeve 32 as stated above may be implemented by a stepping motor. The motor is controlled by an exclusive controller to drive the cleaning sleeve 32 at the high and low speeds repetitively.

The developing units 21Y, 21M, 21C and 21B shown in FIG. 1 have developing sleeves 50Y, 50M, 50C and 50B, respectively, for transporting a mixture of toner and carrier while magnetically retaining it thereon. When the copier has this kind of developing units, at least one of the developing units 21Y to 21B may be used to remove a film from the drum 18 in exactly the same manner as the cleaning sleeve 32. Specifically, an arrangement may be made such that in the film removing mode at least one of the developing sleeves 50Y to 50B is rotated at a low speed to feed a great amount of agent (developer in this case) to the region where the developing sleeve faces the drum 18 for thereby removing a film from the drum 18, and then the developing sleeve is rotated at a high speed to reduce the amount of agent passing its associated doctor blade and thereby the amount of agent to be transported to the particular region. This prevents the developing sleeve and/or the drum 18 from being stopped by an excessive load otherwise created by the developer.

Of course, any of the implementations which use a cleaning device or developing units as described above is applicable to a monochromatic copier which is provided with a single developing unit.

Generally, the cleaning agent C retained on the cleaning sleeve 32 is lower in toner concentration than the developer retained on the developing sleeve. Therefore, when the cleaning agent C of the cleaning device 27 is rubbed against the drum 18 for removing a film, carrier particles in the agent C will contact the drum 18 with a greater probability to further enhance the film removing effect, compared to the case wherein the developer on the developing sleeve is used.

Concerning the drum cleaning effect, it is preferable to use a cleaning agent C containing carrier particles the shape of which is not uniform, i.e., angular particles, as stated earlier. Such an angular carrier also serves to promote the film removing effect. On the other hand, carrier particles contained in the developer which is retained on the developing sleeve is usually spherical and, therefore, somewhat lower than the carrier of the cleaning agent C with respect to the film removing effect. In this respect, the illustrative embodiment will be more effective when applied to the cleaning device than when applied to the developing device. If desired, the illustrative embodiment may be applied to both of the developing device and the cleaning device for scraping a film off the drum 18 in a shorter period of time.

While the illustrative embodiment has concentrated on the cleaning sleeve 32 or the developing sleeve which is driven in a rotary motion relative to stationary magnets, the present invention is similarly applicable to an arrangement wherein the magnets accommodated in any of the sleeves or both of the magnets and the sleeve are rotated relative to each other for transporting the cleaning agent C or the developer. In such a case, in the film removing mode, the magnets or the sleeve will be rotated at a low speed to increase the amount of cleaning agent C or that of developer being transported to the region between the sleeve and the drum 18 and then rotated at a high speed to reduce it.

While the cleaning sleeve 32 shown in FIG. 2 is rotated at a low speed for transporting a greater amount of cleaning agent C to the cleaning region X as stated above, the agent C is apt to slip on the periphery of the sleeve 32 because the sleeve 32 has a smooth surface as illustrated. The slippage reduces the retaining force of the cleaning sleeve 32 acting on the cleaning agent C and, in the worst case, prevents a sufficient amount of agent C from being fed to the cleaning region X.

Figure 4:
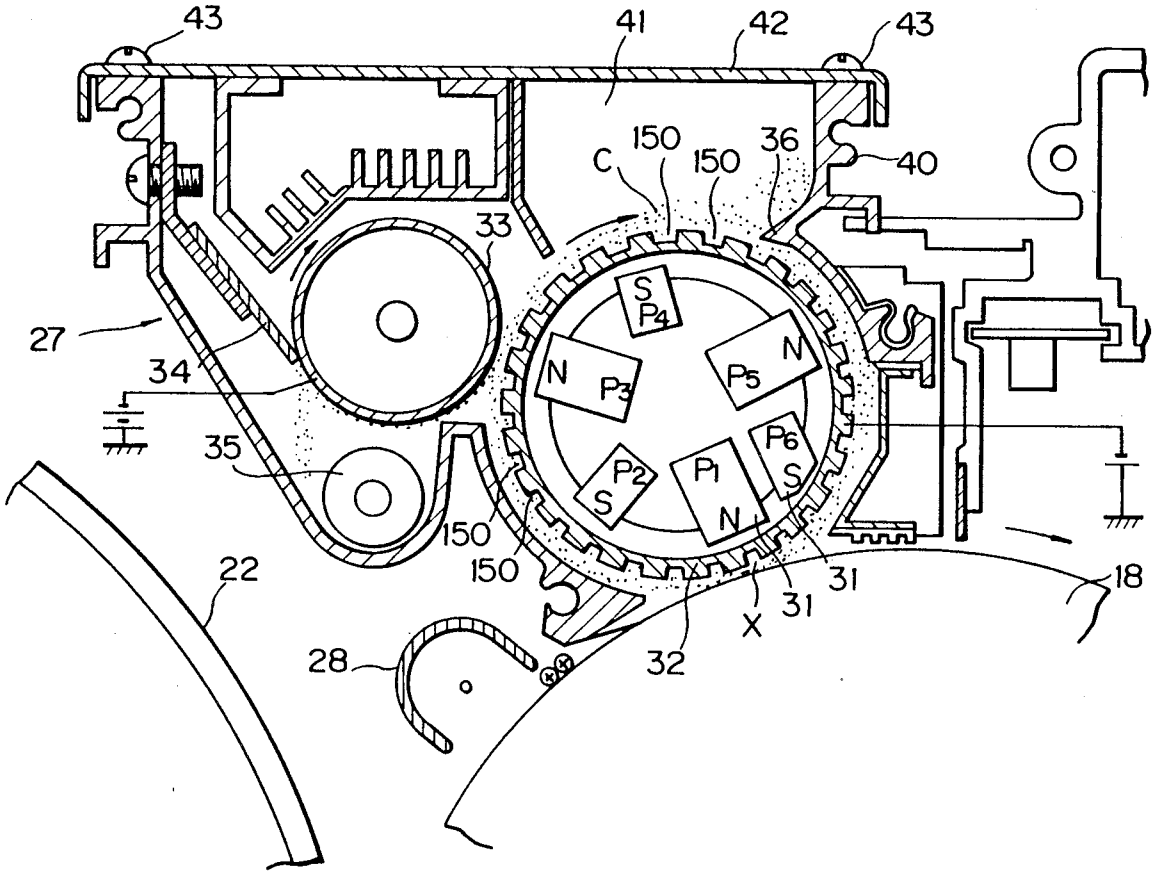
FIG. 4 is a section showing another specific construction of the magnetic brush type cleaning apparatus.
Figure 5:
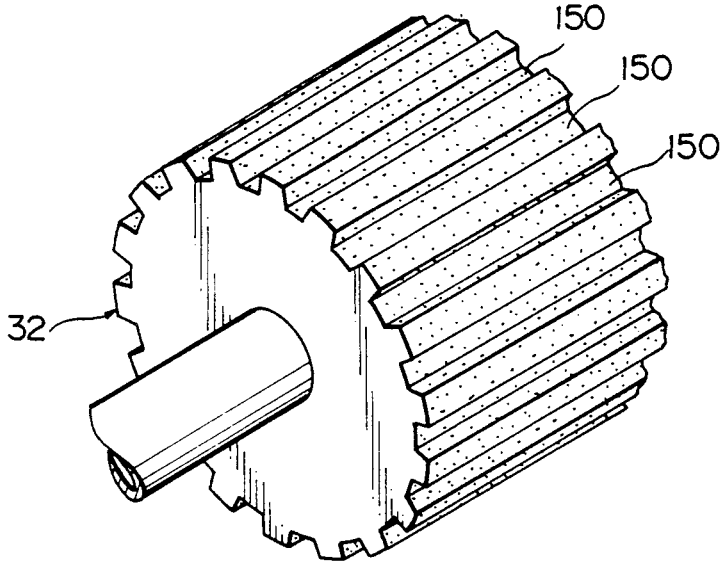
FIG. 5 is a perspective view showing a cleaning sleeve which is provided with grooves and roughened surface in accordance with the present invention.

Referring to FIG. 4, an alternative embodiment of the present invention is shown which is provided with a countermeasure against the slippage of the cleaning agent. As shown, the cleaning sleeve 32 are formed with a number of grooves 150 on the periphery thereof and, further, roughened by sand blasting or similar technology over the entire surface thereof. In FIG. 5 which is a perspective view of such a cleaning sleeve 32, the roughened surface of sleeve 32 is represented by a number of dots. By the roughening, a number of microscopic lugs and recesses are formed on the surface of the cleaning sleeve 32 and have an average height which is selected to be 15 microns to 30 microns, for example. The rest of the construction shown in FIGS. 4 and 5 is exactly the same as the construction of FIGS. 1 to 3.

In the configuration shown in FIGS. 4 and 5, the cleaning sleeve 32 has relatively large lugs and recesses defined by the grooves 150 and microscopic lugs and recesses formed by roughening on the periphery thereof. These lugs and recesses increases the retaining force of the cleaning sleeve 32 acting on the cleaning agent C, so that agent C forms a stiff magnet brush and is transported by a greater amount. More specifically, when the amount of cleaning agent C being fed to the cleaning region X is to be increased to implement the film removing mode, the cleaning sleeve 32 retains a great amount of cleaning agent C thereon while suppressing the slippage so as to feed a sufficient amount of agent C to the cleaning region X and, yet, stiffens the magnet brush to effectively remove a film from the drum 18.

Figure 6:
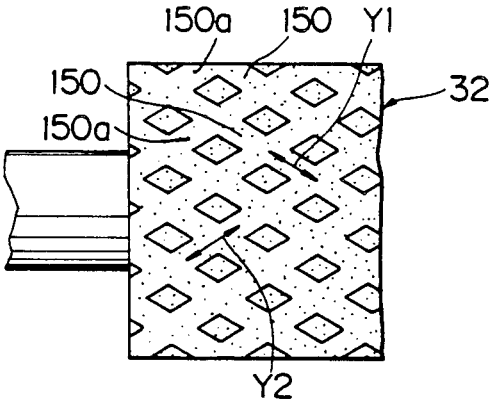
FIG. 6 is a fragmentary front view showing an alternative configuration of the cleaning sleeve.

FIG. 6 shows a modified form of the cleaning sleeve 32 described above with reference to FIGS. 4 and 5. As shown, the modified cleaning sleeve 32 has a plurality of spiral grooves 150 extending in a direction Y1 and a plurality of spiral grooves 150*a* extending in a direction Y2 while intersecting the grooves 150. Again, the entire surface of the cleaning sleeve 32 is roughened to form microscopic lugs and recesses. The configurations of recesses shown in FIGS. 4, 5 and 6 are only illustrative and not restrictive.

The configurations shown in FIGS. 4 to 6 are applicable even to a magnet brush type cleaning unit which is operable in a simple drum cleaning mode only and not in the exclusive film removing mode shown in FIG. 3. Specifically, since the cleaning sleeve 32 having grooves and roughened surface transport a great amount of cleaning agent C to the cleaning region X, the agent C can exert a substantial scraping force on the surface of the drum 18 while an ordinary cleaning operation is under way, i.e., without resorting to an exclusive film removing mode. The agent C, therefore, serves the residual toner removing function and the film removing function at the same time.

Since the cleaning agent C is transported in a greater amount, it also serves to promote further effective removal of residual toner particles during cleaning operation. Specifically, from the drum cleaning standpoint, too, it is preferable that the cleaning agent C be retained on the cleaning sleeve 32 with a minimum of slippage and, yet, transported in a greater amount. Should the amount of cleaning agent C being transported be small, the amount of residual toner which can be transferred from the drum 18 to the carrier of the cleaning agent C would be reduced. Should the retaining force of the cleaning sleeve 32 acting on the cleaning agent C be weak, the agent C rubbing against the surface of the drum 18 would slip on the sleeve 32 and thereby fail to sufficiently scrape the residual toner particles off the drum 18.

The cleaning sleeve 32 shown in any of FIGS. 4 to 6 is successful in retaining a great amount of cleaning agent C thereon while restricting the slippage of the agent C on the sleeve 32. In this condition, the agent C exerts a strong scraping force on the toner remaining on the rum 18 and allows the removed toner to effectively deposit on the carrier of the agent C.

In FIGS. 4 to 6, the strong force of the cleaning sleeve 32 for retaining the cleaning agent C is derived from the grooves and roughening and is exhibited while the sleeve 32 is in rotation. Hence, this kind of configuration will not be so significant when it comes to a cleaning device of the type causing the magnets 31 to rotate relative to the cleaning sleeve 32.

In the cleaning device 27 shown in FIGS. 2 and 4, the removal of a film from the drum 18 owes mainly to the scraping force of the carrier which is contained in the cleaning agent C. Therefore, when the toner concentration of the cleaning agent C is excessively high, i.e., when a great amount of toner is deposited on the carrier particles, the film removing effect is degraded. Generally, the residual toner on the drum 18 is not uniformly distributed on the drum 18 and exists in substantial amounts in some areas and does not exist at all or hardly exists at the other areas. It follows that the cleaning agent on the cleaning sleeve 32 having collected the residual toner from the drum 18 has an non-uniform toner concentration distribution along the axis of the sleeve 32, i.e., the toner concentration is comparatively high in some portions of the cleaning agent and comparatively low in the other portions. Such a non-uniform toner concentration distribution is left in the cleaning agent C from which the toner has been collected by the toner collecting roller 33. With such a cleaning agent C, the film removing effect would be locally degraded on the drum 18. Specifically, while the portions of the cleaning agent C having low toner concentrations remove a film effectively, the others having high toner concentrations fail to do so.

Figure 7:
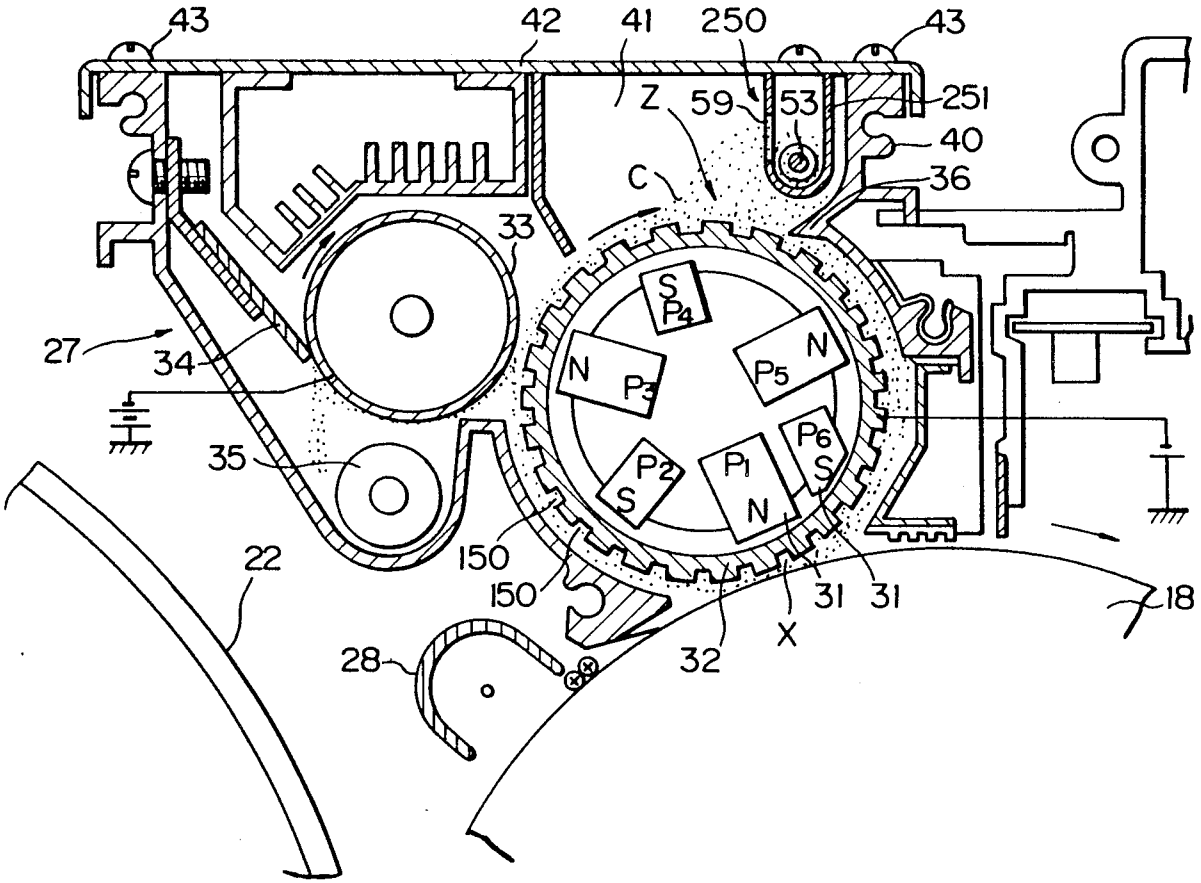
FIG. 7 is a section showing another specific construction of the magnet brush type cleaning device.
Figure 8:
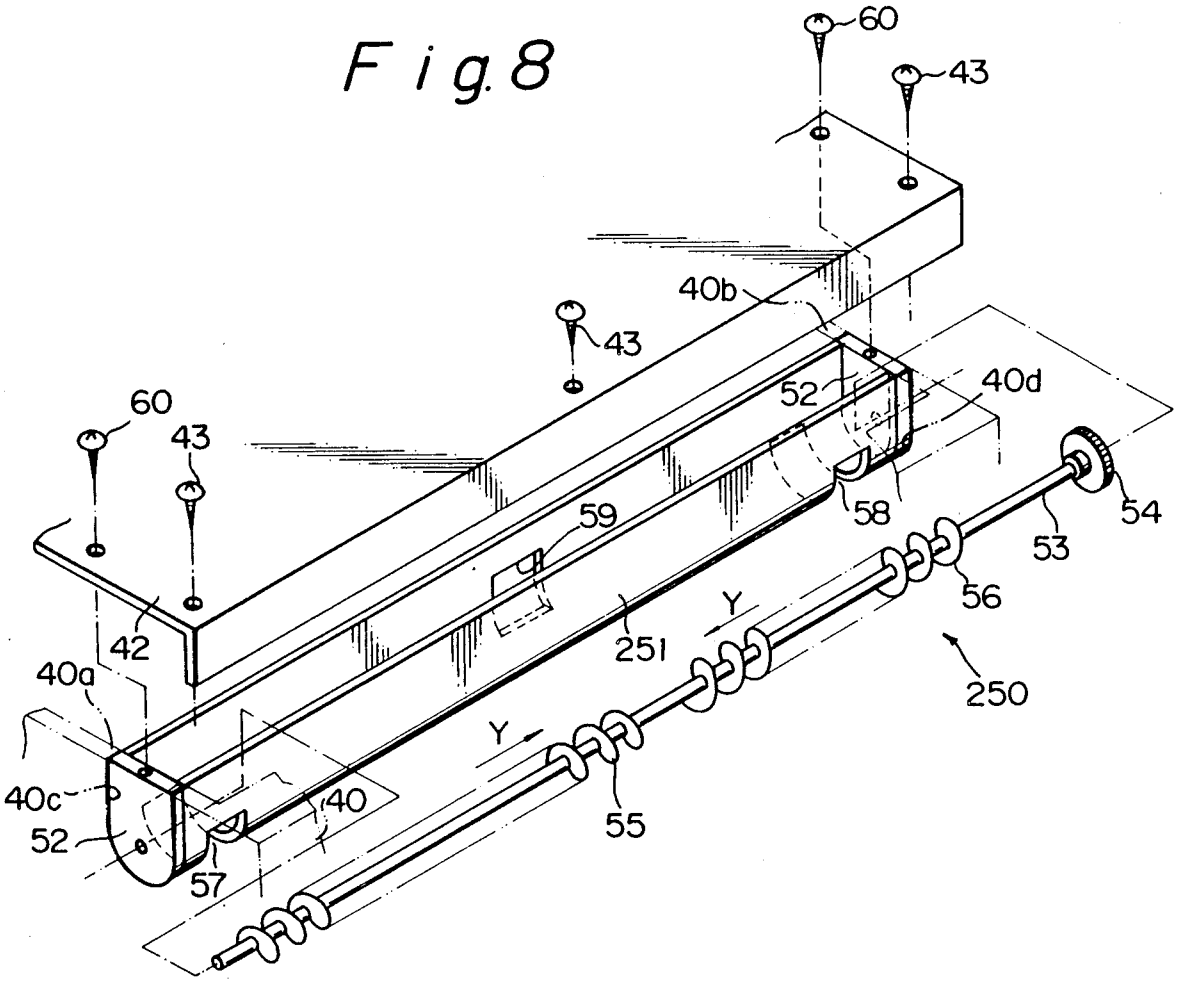
FIG. 8 is an exploded perspective view of agent agitating means.

Referring to FIGS. 7 and 8, an alternative embodiment of the present invention is shown which is constructed and arranged to solve the above-discussed problem. As shown, agent agitating means 250 extends along the axis of the cleaning sleeve 32 (perpendicularly to the sheet surface of FIG. 7) for agitating the cleaning agent C and thereby setting up a uniform toner concentration in the axial direction of the sleeve 32. As shown in FIG. 8, the agent agitating means 250 comprises a trough-like guide member 251 which extends in parallel to the axis of the cleaning sleeve 32. A screw shaft 53 is journalled to opposite end walls 52 of the guide member 251. A gear 54 is rigidly mounted on one end of the screw shaft 53 which protrudes from one end wall 52 of the guide member 251. The gear 54 is held in mesh with a drive gear (not shown) which is mounted on the copier body. The screw shaft 53 has thereon screws 55 and 56 which adjoin each other at substantially the intermediate between opposite ends of the shaft 53 and are turned in opposite directions to each other. The guide member 251 is received in top-open notches 40*c* and 40*d* which are respectively formed in opposite side walls of the cleaning case 40. The guide member 251 is fastened to the inner periphery of the cover 42 by screws 60. Agent inlets 57 and 58 are formed through the guide member 251 at opposite end portions of the latter, while an agent outlet 59 is formed through the guide member 251 at the intermediate between the agent inlets 57 and 58.

The cleaning sleeve 32 shown in FIG. 7 is also provided with the grooves 150 and roughened surface. The rest of the construction shown in FIGS. 7 and 8 is the same as the construction shown in FIGS. 1 to 3.

In operation, the cleaning agent C on the cleaning sleeve 32 is scraped off by the doctor blade 36 and stays in the vicinity of the blade 36. As the screw shaft 53 is rotated, this part of the cleaning agent C is taken into the guide member 251 by the screws 55 and 56 via the agent inlets 57 and 58. Since the screws 55 and 56 are turned in opposite directions as mentioned previously, they drive the cleaning agent C toward the center of the screw shaft 53 as indicated by arrows Y in FIG. 8. At the center of the screw shaft 53, the cleaning agent C is dropped onto the cleaning sleeve 32 via the agent outlet 59 of the guide member 251. Although the cleaning agent C let fall onto the cleaning sleeve 32 forms a generally conical heap, it is sequenatilly shifted toward opposite ends of the cleaning sleeve 32 and thereby leveled. While the cleaning agent C is so circulated along the axis of the cleaning sleeve 32, the carrier and toner contained therein are agitated to set up a uniform toner distribution while being effectively charged by friction. The cleaning agent C with the uniform toner distribution is brought to the cleaning region X for removing a film from the drum 18. This insures uniform removal of a film over the entire surface of the drum 18.

In FIG. 7, it is noteworthy that two magnets P4 and P5 positioned in a part of the cleaning unit 27 that faces the doctor blade 36 are widely spaced apart from each other, and one P4 of the two magnets exerts a weaker magnetic force than the others. Therefore, in the region Z defined above the magnet P4 and extending to the doctor blade 36, the magnetic force is weaker than in the other regions around the cleaning sleeve 32. The agent agitating means 250 is located in such a particular region Z. More specifically, the agent agitating means 250 is disposed in a position above the cleaning sleeve 32 where the magnetic retaining force acting on the cleaning agent C is weak. This readily allows the cleaning agent C to be separated from the cleaning sleeve 32 and drawin into the guide member 251 of the agitating means. Should the agitating member 250 be located in a position where the magnetic force is strong, the cleaning agent C would be strongly attracted toward the cleaning sleeve 32 and would not enter the guide member 251 with ease.

As the cleaning agent C is used over a long period of time, the carrier is sequentially deteriorated to lower the film removing ability or the cleaning ability. To implement the replacement of the old cleaning agent C with a fresh agent which will be neede from time to time, the cleaning device 27 is constructed into a unit and can be pulled out at the front end of the copier body (toward the viewer in a direction perpendicular to the sheet surface of FIGS. 2, 4 and 7). Specifically, after the cleaning unit 27 has been pulled out of the copier body, the screws 43 are loosened to remove the cover 42. Then, the cleaning unit 27 is turned upside down to let the cleaning agent C fall through the uncovered opening 41. Subsequently, a new cleaning agent is filled in the cleaning unit 27 through the opening 41. Since the magnetic force acting in the region Z, FIG. 7, within the cleaning case 40 is weak, one can readily discharge the cleaning agent C through the opening 41 by rotating the cleaning sleeve 32 by hand to move the agent C on the cleaning sleeve 32 to the region Z.

In the arrangement shown in FIG. 7, the agitating means 250 is located in close proximity to the opening 41 of the cleaning case 40. Therefore, if the agitating means 250 is positioned in the cleaning case 40 even after the removal of the cover 42, it will interfere with the the replacement of the cleaning agent C. In the light of this, the agent guide member 250 of the agitating means 250 is fastened to the cover 41 by the screws 60, so that the agitating means 250 may be removed from the cleaning case 40 together with the cover 42. Specifically, when the cover 42 is raised away from the cleaning case 40, the agitating means 250 is lifted together with the cover 42 with the guide member 251 being released from the notches 40*c* and 40*d*.

Figure 9:
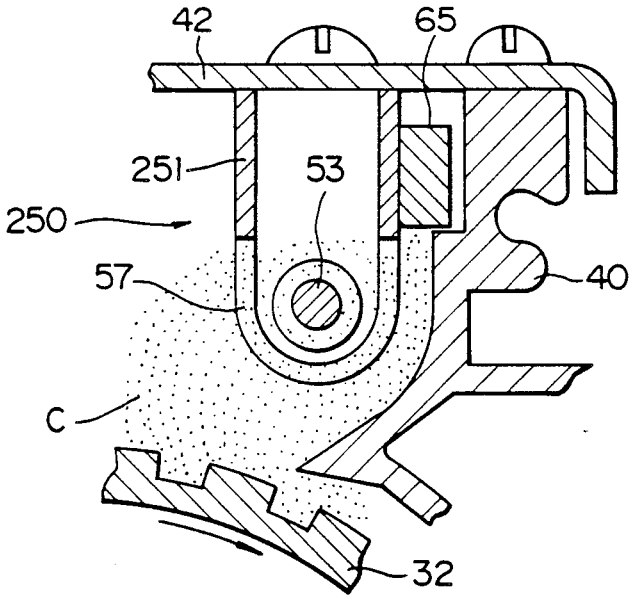
FIG. 9 is a fragmentary section showing an alternative embodiment of the present invention.
Figure 10:
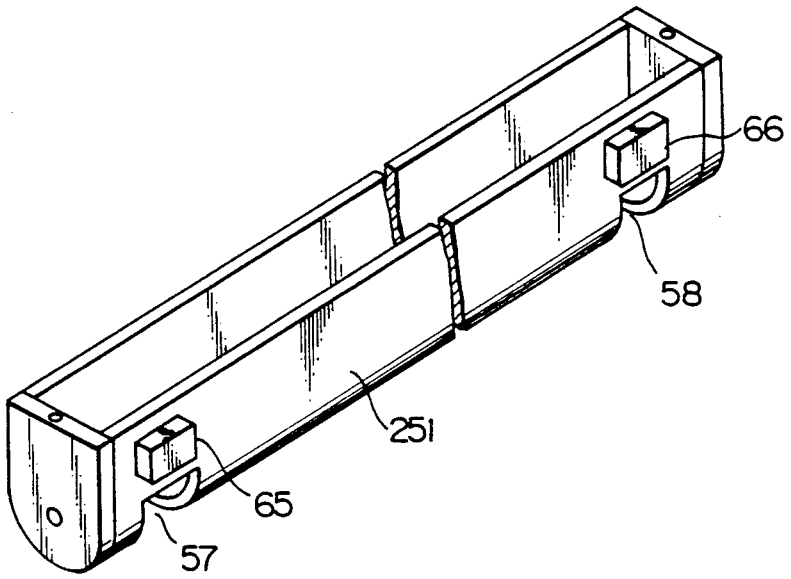
FIG. 10 is a perspective view of a guide member and magnets affixed to the guide member in accordance with the embodiment of FIG. 9.

To allow the agent agitating means 250 to agitate the cleaning agent C efficiently, it is desirable that a great amount of cleaning agent C be drawn into the agitating means 250 away from the cleaning sleeve 32. The illustrative embodiment meets such a requirement by weakening the magnetic force acting in the particular region Z, as stated earlier. An alternative implementation is shown in FIGS. 9 and 10. In FIGS. 9 and 10, magnets 65 and 66 are affixed to the guide member 251 adjacent to the agent inlets 57 and 58 so as to positively attract the cleaning agent C being deposited on the cleaning sleeve 32 toward the agitating means 250. The cleaning agent C so attracted by the magnets 65 and 66 will be drawn into the guide member 251 and then conveyed by the screw shaft 53. This alternative implementation is also successful in increasing the amount of cleaning agent C to be agitated and, therefore, in enhancing efficient agitation. While the magnets 65 and 66 are shown in FIGS. 9 and 10 as being affixed to the agent guide member 251, they may alternatively be mounted on any other suitable member such as the cleaning case 40.

The constructions shown in FIGS. 7 to 10 are practicable with a cleaning device in which at least one of the cleaning sleeve 32 and magnets 31 is rotatable. However, when the magnetic force of the magnet P4 is comparatively weak as stated previously and if all the magnets 31 inclusive of the magnet P4 are driven in a rotation motion, the cleaning agent C is apt to drop onto the drum 18 when the magnet P4 is lowered. It is, therefore, preferable to rotate the cleaning sleeve 32 while holding the magnets 31 stationary.

The part of the arrangement shown in FIGS. 7 to 10 which relates to the agent agitating means is also applicable to a cleaning device which uses the cleaning sleeve 32 having the grooves 150 and roughened surface and lacks the exclusive film removing mode shown in FIG. 3. Conversely, when the film removing mode is adopted, the above-mentioned part is similarly applicable to a cleaning device of the type using the cleaning sleeve 32 having a smooth surface.

Since the cleaning agent C is agitated along the axis of the cleaning sleeve 32, the removal of residual toner from the drum 18 is also enhanced. When the toner concentration of the cleaning agent C is excessively high, i.e., when a great amount of toner is deposited on the carrier particles, the residual toner cannot be readily deposited on the carrier particles resulting in the cleaning ability being degraded. Conversely, when the toner concentration is excessively low, the carrier particles in the agent C cannot be sufficiently charged by friction and fail to sufficiently attract the residual toner, also resulting in the cleaning ability being degraded. In this manner, the cleaning ability depends on the toner concentration of the cleaning agent C. Although the toner collecting roller 33 may collect an adequate amount of toner from the cleaning agent C in order to control the toner concentration of the agent C to a proper range, the toner concentration of the agent C on the cleaning sleeve 32 is distributed irregularly in the axial direction of the sleeve 32 due to the non-uniform distribution of toner remaining on the drum 18, as discussed earlier. Assuming that a substantial amount of residual toner exists in an intermediate portion of the drum 18 while hardly any toner exists in opposite end portions, the toner concentration of the cleaning agent C having collected such residual toner will be higher in the intermediate portion than in the opposite end potions. This non-uniform toner concentration distribution will be left in the cleaning agent C even after the toner collecting roller 33 collects the toner. The cleaning agent C, therefore, cannot sufficiently clean the drum 18 because the toner concentration thereof will not be uniform.

In any of the embodimens shown in FIGS. 7 to 10, the cleaning agent C cleans the drum 18 while being positively agitated along the axis of the cleaning sleeve 32. The cleaning device, therefore, cleans the entire surface of the drum 18 uniformly in the axial direction of the latter.

It is to be noted that the present invention is similarly applicable to a monochromatic copier and even to image forming apparatuses other than a copier. The present invention is practicable even when the image carrier or the agent carrier is implemented as a belt.

In summary, in accordance with the present invention, a film can be removed from an image carrier effectively and, yet, economically without reducing the life of the image carrier. The image carrier and an agent carrier are free from an excessive load which would otherwise be created by a mass of cleaning agent staying between the image carrier and the agent carrier and would eventually stop the movement of the latter.

Another advantage attainable with the present invention is that a cleaning agent is strongly retained on the agent carrier and transformed in a great amount to thereby stiffen a magnetic brush which it forms, whereby efficient removal of a film is further promoted.

Also, the cleaning agent is agitated in the axial direction of the agent carrier to maintain a uniform toner concentration distribution therein. This allows a film on the image carrier to be removed uniformly and effectively over the entire surface of the image carrier.

Furthermore, in accordance with the present invention, a great amount of cleaning agent is drawn toward agent agitating means and, therefore, agitated efficiently.

Various modifications will become possible for those skilled in the art after receiving the teachings of the present disclosure without departing from the scope thereof.

What is claimed is:

1. A method of removing a film from an image carrier for an image forming apparatus comprising:

said image carrier for forming a toner image thereon during an image forming mode operation;

an agent carrier located to face said image carrier for transporting an agent, which is a mixture of carrier and toner and at least partly constituted by a magnetic substance, while retaining said agent on said agent carrier; and regulating means for regulating an amount of said agent to be transported to a region between said image carrier and said agent carrier;

said method comprising the steps of:

(a) transporting, at a time other than a time when the image forming mode operation is under way, an amount of the agent, great enough to scrape the film off said image carrier, to said region between said image carrier and said agent carrier;

(b) reducing, at a time other than a time when the image forming mode of operation is under way, the amount of the agent to be fed to said region to prevent jamming of an operation of one of the image carrier and agent carrier due to an excess of agent at the region between said image carrier and said agent carrier; and (c) performing steps (a) and (b) a plurality of time.

2. A method as claimed in claim 1, wherein step (a) comprises (d) transporting the agent retained on said agent carrier by driving said agent carrier in a rotary motion.

3. A method as claimed in claim 2, further comprising (e) setting a linear velocity VP of said image carrier and a linear velocity VS of said agent carrier such that a relation $0<|VS/VP|<0.5$ and a relation $|VS/VP|>0.5$ are satisfied in steps (a) and (b), respectively.

4. A method as claimed in claim 1, wherein the agent comprises a cleaning agent.

5. A method as claimed in claim 4, wherein said agent carrier comprises a cleaning sleeve in which magnets are accommodated.

6. A method as claimed in claim 5, wherein said cleaning sleeve comprises a number of grooves formed on outer periphery thereof.

7. A method as claimed in claim 6, wherein said cleaning sleeve is roughened over the entire periphery thereof.

8. A method as claimed in claim 5, wherein step (a) comprises (d) driving said cleaning sleeve in a rotary motion.

9. A method as claimed in claim 8, further comprising, between steps (a) and (b), (e) rubbing said cleaning agent against said image carrier.

10. A method as claimed in claim 9, further comprising (f) agitating the cleaning agent in an axial direction of said cleaning sleeve by agitating means.

11. A method as claimed in claim 10, wherein step (f) comprises (g) feeding the cleaning agent on said cleaning sleeve into said agitating means.

12. A method of removing a film from an image carrier of an image forming apparatus comprising:

said image carrier for forming a toner image thereon during an image forming mode operation;

an agent carrier located to face said image carrier for transporting an agent which is a mixture of carrier and toner and at least partly constituted by a magnetic substance while retaining said agent on said agent carrier; and regulating means for regulating an amount of said agent to be transported to a region between said image carrier and said agent carrier;

said method comprising the steps of:

(a) transporting, by driving said agent carrier in a rotary motion, at a time other than a time when the image forming mode operation is under way, an amount of the agent retained on said agent carrier great enough to scrape the film off said image carrier to said region between said image carrier and said agent carrier;

(b) reducing the amount of the agent to be fed to said region;

(c) performing steps (a) and (b) a plurality of times; and (d) setting a linear velocity VP of said image carrier and a linear velocity VS of said agent carrier such that a relation $0<|VS/VP|<0.5$ and a relation $|VS/VP|>0.5$ are satisfied in steps (a) and (b), respectively.

13. A method of removing a film from an image carrier of an image forming apparatus comprising:

said image carrier for forming a toner image thereon during an image forming mode operation;

an agent carrier located to face said image carrier for transporting a cleaning agent which is a mixture of carrier and toner and at least partly constituted by a magnetic substance while retaining said cleaning agent on said agent carrier, said agent carrier comprising a cleaning sleeve in which magnets are accommodated, said cleaning sleeve comprising a number of grooves formed on an outer periphery thereof; and regulating means for regulating an amount of said cleaning agent to be transported to a region between said image carrier and said agent carrier;

said method comprising the steps of:

(a) transporting, at a time other than a time when the image forming mode operation in under way, an amount of the cleaning agent great enough to scrape the film off said image carier to said region between said image carrier and said agent carrier;

(b) reducing the amount of the cleaning agent to be fed to said region; and (c) performing steps (a) and (b) a plurality of times.

14. A method as claimed in claim 13, wherein said cleaning sleeve is roughened over the entire periphery thereof.

15. A method of removing a film from an image carrier of an image forming apparatus comprising:

said image carrier for forming a toner image thereon during an image forming mode operation;

an agent carrier located to face said image carrier for transporting a cleaning agent which is a mixture of carrier and toner and at least partly constituted by a magnetic substance while retaining said cleaning agent on said agent carrier, said agent carrier comprising a cleaning sleeve in which magnets are accommodated; and regulating means for regulating an amount of said cleaning agent to be transported to a region between said image carrier and said agent carrier;

said method comprising the steps of:

(a) transporting by driving said cleaning sleeve in a rotary mode, at a time other than a time when the image forming mode operation is under way, an amount of the cleaning agent great enough to scrape the film off said image carrier to said region between said image carrier and said agent carrier;

(b) rubbing said cleaning agent against said image carrier;

(c) reducing the amount of the cleaning agent to be fed to said region; and (d) performing steps (a) to (c) a plurality of times.

16. A method as claimed in claim 15, further comprising the step of: (e) agitation the cleaning agent in an axial direction of said cleaning sleeve by agitating means.

17. A method as claimed in claim 16, wherein step (e) further comprises feeding the cleaning agent on said cleaning sleeve into said agitating means.

* * * * *